US006993951B1

(12) United States Patent
Sudau et al.

(10) Patent No.: US 6,993,951 B1
(45) Date of Patent: Feb. 7, 2006

(54) BENDING DEVICE FOR THE WORKING ROLLS OF A HOT-ROLLING FRAME

(75) Inventors: Peter Sudau, Hilchenbach (DE); Heinz-Adolf Müller, Wilnsdorf (DE); Stephan Fischer, Hilchenbach (DE)

(73) Assignee: SMS Schloemann-Siemag AG, Düsseldorf (DE)

( * ) Notice: Subject to any disclaimer, the term of this patent is extended or adjusted under 35 U.S.C. 154(b) by 0 days.

(21) Appl. No.: 09/979,949

(22) PCT Filed: May 6, 2000

(86) PCT No.: PCT/EP00/04075

§ 371 (c)(1),
(2), (4) Date: May 7, 2002

(87) PCT Pub. No.: WO00/69579

PCT Pub. Date: Nov. 23, 2000

(30) Foreign Application Priority Data

May 14, 1999 (DE) ..... 199 22 373

(51) Int. Cl.
*B21B 29/00* (2006.01)

(52) U.S. Cl. ..... 72/241.8; 72/245

(58) Field of Classification Search ..... 72/241.8, 72/241.2, 240, 239, 237, 245, 247
See application file for complete search history.

(56) References Cited

U.S. PATENT DOCUMENTS 2,430,410 A * 11/1947 Pauls ..... 72/241.8
4,543,810 A * 10/1985 Stoy et al. ..... 72/241.8
4,736,609 A * 4/1988 Schiller et al. ..... 72/244
4,907,439 A * 3/1990 Diel et al. ..... 72/247
5,090,228 A * 2/1992 Schmiedberg et al. ..... 72/238
5,638,716 A * 6/1997 Jonen ..... 72/241.8

FOREIGN PATENT DOCUMENTS

| | | | |
|---|---|---|---|
| DE | 3331 055 | * | 3/1985 |
| DE | 3728 795 | * | 3/1989 |
| DE | 3728795 | | 3/1989 |
| DE | 4308743 | | 9/1994 |
| DE | 195 36 042 A1 | | 4/1997 |
| EP | 0623401 | | 11/1994 |

OTHER PUBLICATIONS

Patent Abstracts of Japan, vol. 009, No. 046 (M-360), Feb. 27, 1985 & JP 59185505 A (Ishikawajima Harima Jukogyo KK), Oct. 22, 1984.
Patent Abstracts of Japan, vol. 008, No. 284 (M-348), Dec. 26, 1984 & JP 59 153505 A (Ishikawajima Harima Jukogyo KK), Sep. 1, 1984.
Patent Abstracts of Japan, vol. 010, No. 211 (M-501), Jul. 24, 1986 & JP 61 052914 A (Ishikawajima Harima Jukogyo KK), Mar. 15, 1986.

* cited by examiner

*Primary Examiner*—Lowell A. Larson
(74) *Attorney, Agent, or Firm*—Friedrich Kueffner

(57) ABSTRACT

A hot-rolling stand including blocks arranged in the stand windows and having hydraulic piston cylinder units provided as bending devices which are able to transfer bending forces via guide elements onto the chocks of the working rolls. For each block a double-acting hydraulic piston cylinder unit is provided whose two ends are connected with the guide elements. The guide elements have guide that engage both sides of the free ends of noses of the working roll chocks so as to permit axial movement of the working rolls.

4 Claims, 1 Drawing Sheet

BENDING DEVICE FOR THE WORKING ROLLS OF A HOT-ROLLING FRAME

BACKGROUND OF THE INVENTION

The invention relates to blocks arranged in stand windows of hot rolling stands comprising hydraulic piston cylinder units provided as bending device which can transmit bending forces onto the chocks of the working rolls via guide elements.

Particularly in the case of cold-rolling stands it has been found to be beneficial to arrange bending devices for the working rolls in blocks which are preferably arranged at least partially in the recesses of the stand beams. Difficulties resulted in connection with this configuration because it is desired that the bending devices provide positive as well as negative forces and since, moreover, a relative movability of the working rolls in the axial direction relative to one another is demanded. Critical in this connection is also the space requirement of the bending devices which limits the possibilities of the support of the support rolls.

DE 195 36 042 A1 discloses a guide device for four-high and multi-high cold-rolling stands which get by with one bending cylinder on each side of the chocks. An axial movement of the rolls is ensured in that the bending blocks are arranged moveably in axial guides fixedly connected to the stand window. These guides cause the stand windows to be greatly constricted.

A transfer of the solutions found in connection with cold-rolling stands onto hot-rolling trains is practically impossible because the maximum forces to be developed here surpass those required for cold rolling by a factor of 3. In particular, it was found that at the operating pressure in question, the forces to be applied can no longer be developed by a single hydraulic piston cylinder unit of an acceptable size, respectively; in the case of hot-rolling stands the blocks comprising bending devices have therefore been provided with a complex configuration and with a number of, for example, 6 up to 12 parallel operating piston cylinder units, i.e., up to 24 piston cylinder units per stand. Moreover, it was found to be disturbing that the bending devices had such large dimensions that a free design of the support of the support rolls is no longer possible and, for example, Morgoil bearings can no longer be used and rolling bearings have to be employed.

SUMMARY OF THE INVENTION

The invention is thus based on the object to provide working roll bending devices of the aforementioned kind which are capable of effecting the advancing forces to be applied by means of a single piston cylinder unit and whose dimensions are so small that a simple arrangement within the blocks to be provided in the stand window is made possible and the free selection of the bearings of the support rolls remains ensured.

This object is solved by a hot-rolling stand comprising blocks arranged in the stand windows, which blocks comprise hydraulic piston cylinder units provided as bending devices which are able to transfer bending forces via guide elements onto the chocks of the working rolls. For each block a double-acting hydraulic piston cylinder unit is provided whose two ends are connected with the guide elements. The guide elements have guide grooves that engage both sides of the free ends of noses of the working roll chocks to thereby allow an axial movement of the working rolls. These features make possible the configuration of bending devices which constrict the stand window only moderately and therefore provide sufficient space for the chocks of the support rolls as well as their bearings.

In detail, the features of the invention are explained with the aid of the description of one embodiment in connection with the drawing illustrating it.

DETAILED DESCRIPTION OF THE INVENTION

Figure 1:
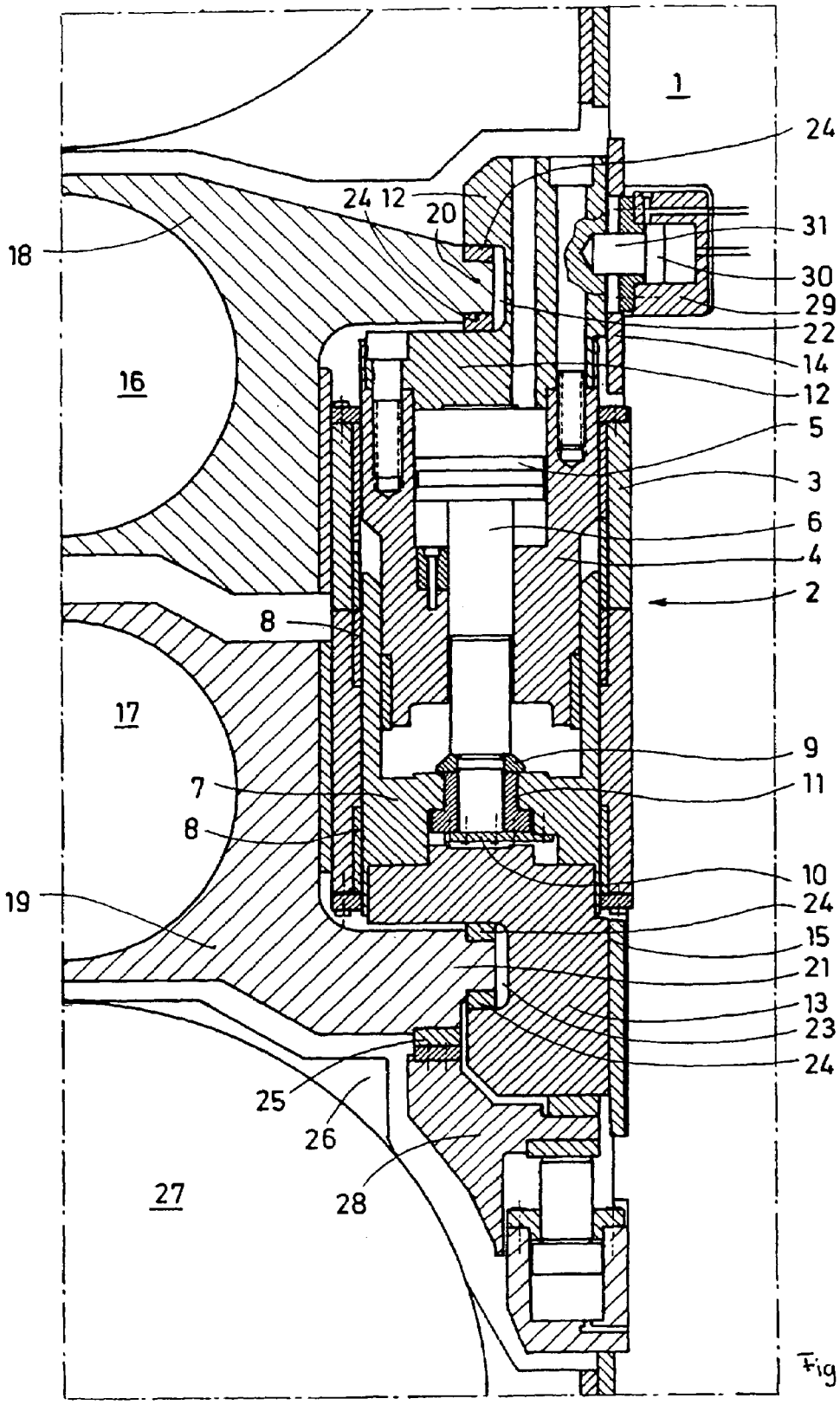
FIG. 1 is a section through a bending device pursuant to the present invention.

In the FIGURE a beam 1 of a frame of a hot-rolling stand is illustrated in a detail view and is provided with a bending device illustrated in vertical section. The important components of this bending device 2 are arranged in a hollow-cylindrical housing 3. A vertically movable pressure cylinder 4 contains in its upper widened area, which is guided within the housing 3, a piston 5 whose piston rod 6 is guided in the lower area of the pressure cylinder 4, which has a reduced outer diameter, within a plunger sleeve 7. The sleeve, in turn, is guided by the wear surfaces 8 of the housing 3. The piston rod 6 penetrates a flange of the plunger sleeve 7 and is supported thereon by means of a pressure ring 9 while the end bushing 11, secured by an end plate 10, is able to transmit tensile forces of the piston rod 6. The end plate 10 is provided with a lateral nose which engages a cutout of the plunger sleeve 7 which nose, together with a bolt connected thereto, serves as a rotary securing means for the piston 5 and the piston rod 6.

A guide element 12, 13 is connected to the end face of the pressure cylinder 4 as well as the lower front of the plunger sleeve 7, respectively, and supported rearwardly in the stand window by and aligned with vertical wear plates 14, 15.

The working rolls 16, 17 of the hot-rolling stand, embodied as a four-high stand, are supported with bearings, not illustrated, in the chocks 18, 19. These chocks have laterally projecting noses 20, 21 which engage grooves 22, 23 of the guide elements 12, 13 and are supported by means of pressure plates 24 against their flanks to thereby allow an axial movement of the working rolls. The nose 21 is provided with a further pressure plate on which the complete working roll set can be moved for exchanging them.

In operation the following function results: The nose 20 of the chock 18 secures the guide piece 12 by means of the pressure plates 24 supported on the flanks of the groove 22 at a height correlated with the working roll 16, while the position of the working roll 17 determines by the nose 21 and its pressure plates 24 supported on the flanks of the groove 23 the height of the guide element 13. The plunger sleeve 7 and the piston rod 6 of the piston 5 are connected with the guide element 13, while the guide element 12 is screwed onto the pressure cylinder 4. This means that the position of the chocks 18 and 19 also determines the position of the piston 5 in the pressure cylinder 4. Corresponding to the applied control, the upper and/or the lower cylinder chamber formed within the pressure cylinder 4 is now pressurized and thus the surfaces of the double-acting piston 5 are correspondingly loaded. The forces which are thus developed on the piston surfaces are then transmitted to the guide elements 12, 13 which are vertically moveable by means of the guide surfaces of the pressure cylinder 4 and of plunger sleeve 7 in the housing 3 and load via the noses 20, 21 the chocks 18, 19 with the required pre-stress.

For exchanging the rolls, the working rolls 16, 17 are lifted by the lifting rail 28 wherein the lower chock 19 is supported with its pressure plate 25 provided on the nose 21 on the lifting rail 28.

For the exchange of rolls it is expedient and known to secure the parts of the bending device in the position predetermined for the exchange of rolls in order to be able to return them without further adjustment after extending the roll. In the illustrated embodiment a hydraulic cylinder 29 is provided here in a cutout of the beam 1 whose piston 30 is provided with a centering bolt 31. In the drawing this bolt is illustrated in the arrested position in which the piston 30 is extended and the bolt 31 has been inserted into a recess of the guide piece 12, thereby holding it at a constant height.

OVERVIEW OF REFERENCE NUMERALS

1. beam
2. bending device
3. housing
4. pressure cylinder
5. piston
6. piston rod
7. plunger sleeve
8. wear surface
9. pressure ring
10. end plate
11. end bushing
12. guide element
13. guide element
14. wear plates
15. wear plates
16. working roll
17. working roll
18. chock
19. chock
20. nose
21. nose
22. groove
23. groove
24. pressure plate
25. pressure plate
26. chock
27. lower support roll
28. lifting rail
29. hydraulic cylinder
30. piston
31. bolt

What is claimed is:

1. Hot-rolling stand comprising blocks arranged in the stand windows comprising hydraulic piston cylinder units provided as bending devices which are able to transfer bending forces via guide elements onto the chocks of the working rolls, wherein for each block a single double-acting hydraulic piston cylinder unit (4, 5) is provided whose two ends are connected with the guide elements (12, 13), and wherein the guide elements (12, 13) have guide grooves (22, 23) that engage both sides of the free ends of noses (20, 21) of the working roll chocks (18, 19) so as to permit axial movement of the working rolls (16, 17), wherein the block is formed as a housing (3) which is provided with support surfaces for wear strips of the working roll chocks (18, 19), and wherein the pressure cylinder (4) of the piston cylinder unit as well as a transmission element (plunger sleeve 7) engaging the piston rod (6) are arranged vertically slidably in the interior of the housing (3).

2. Blocks arranged in the stand windows of hot-rolling stands according to claim 1, wherein one of the guide elements (12) is connected with the pressure cylinder (4) and the second guide element (13) with the transmission element (plunger sleeve 7).

3. Blocks arranged in the stand windows of hot-rolling stands according to claim 1, wherein the guide elements (12, 13) with their sides facing away from the noses (20, 21) of the chocks (18, 19) are supported on vertical wear plates (14, 15) connected to the stand.

4. Blocks arranged in the stand windows of hot-rolling stands according to claim 1, wherein the upper guide element (12) has correlated therewith an adjusting device which comprises a bolt (31) insertable into a recess of the guide element (12).

* * * * *